United States Patent [19]

Smith et al.

[11] Patent Number: 4,907,323

[45] Date of Patent: Mar. 13, 1990

[54] METHOD AND APPARATUS FOR MAKING BIASED FABRIC

[75] Inventors: Donald L. Smith; Curtis L. McDonald; Jim R. Hicks, all of Seguin, Tex.

[73] Assignee: Hexcel Corporation, Dublin, Calif.

[21] Appl. No.: 168,294

[22] Filed: Mar. 15, 1988

[51] Int. Cl.[4] ..... B21D 43/00

[52] U.S. Cl. ..... 29/2.21; 29/2.18; 29/2.19; 29/2.25

[58] Field of Search ..... 29/2.15, 2.18, 2.19, 29/2.2, 2.21, 2.23, 2.25; 26/51.3, 80, 82, 85; 28/157

[56] References Cited

U.S. PATENT DOCUMENTS

| | | | |
|---|---|---|---|
| 1,659,453 | 2/1928 | Berry | 29/2.15 |
| 1,753,645 | 4/1930 | Camfield | 29/2.2 |
| 1,896,596 | 2/1933 | Seddon | 29/2.18 |
| 2,352,937 | 7/1944 | Case | 29/2.23 |
| 2,772,734 | 12/1956 | Judelson | 29/2.2 |

OTHER PUBLICATIONS

Judelshon Jet 220 System Brochure.

*Primary Examiner*—Howard N. Goldberg
*Assistant Examiner*—Irene Cuda
*Attorney, Agent, or Firm*—Arnold, White & Durkee

[57] ABSTRACT

A method and apparatus is provided for producing a woven biased fabric in which the structural fibers are skewed from the fabric centerline. The method and apparatus are particularly designed for producing a woven biased structural fabric in which the structural fibers are oriented about 45° to the fabric centerline, where the flimsy, open-knit nature of the fabric makes handling extremely difficult. Broadly speaking, the apparatus includes a fabric feeding station, slitting station, and winding station. The feeding station holds a roll of conventional structural fabric (parallel and perpendicular structural fibers) woven in a tube configuration and flattened into the roll form. The feeding station rotates the roll in a vertical plane as the fabric unwinds in a horizontal direction. The slitting station includes a cutter and a pair of slatter rolls, the rolls moving the tube of fabric in the horizontal direction while rotating the tube of fabric. The cutter makes a slit in the underside of the moving fabric tube at about a 45° helix angle (or other desired angle). The slit fabric comes off the slatter rolls as a strip of extremely flimsy material with the structural fibers oriented about 45° to the strip centerline. The flimsy strip of fabric is carried in a second direction (about 45°) to the winding station by a moving sheet of plastic. The winding station rolls up both the supporting sheet and biased fabric.

40 Claims, 5 Drawing Sheets

FIG.2
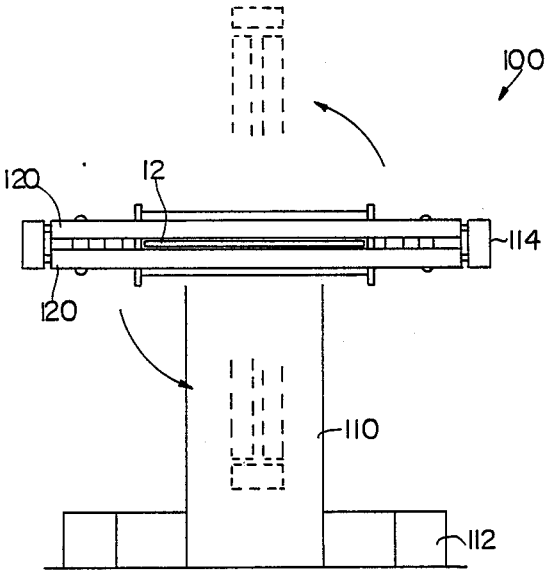
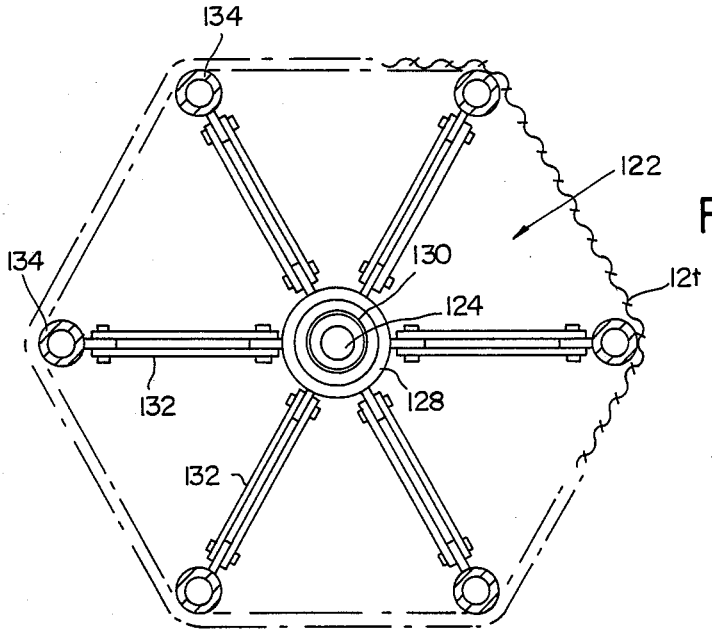
FIG.3
FIG.4
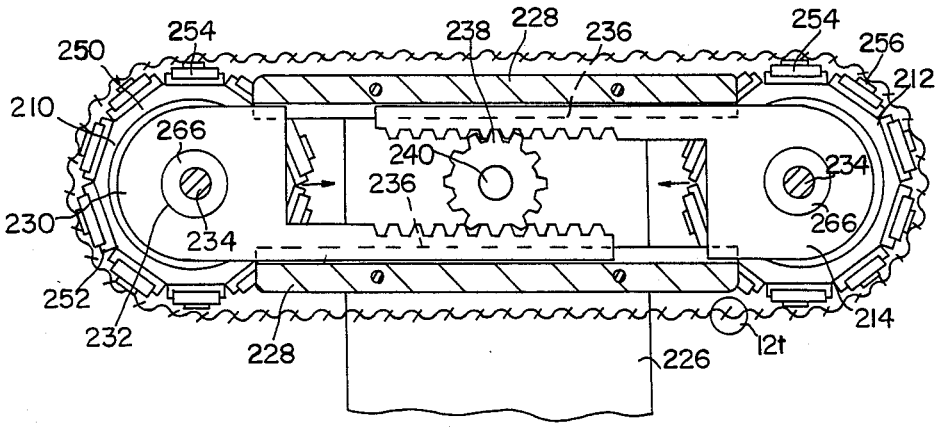

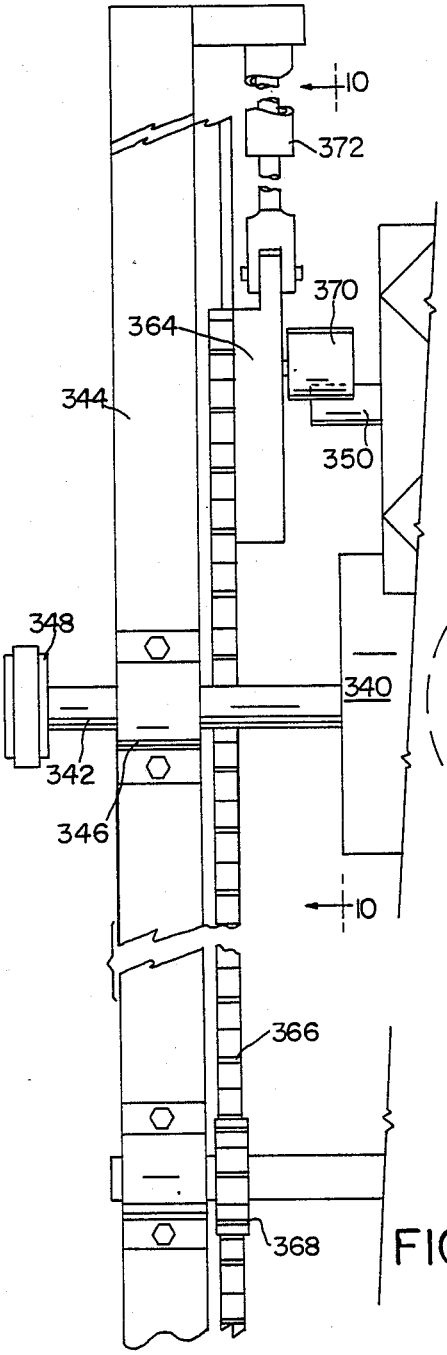
FIG.9
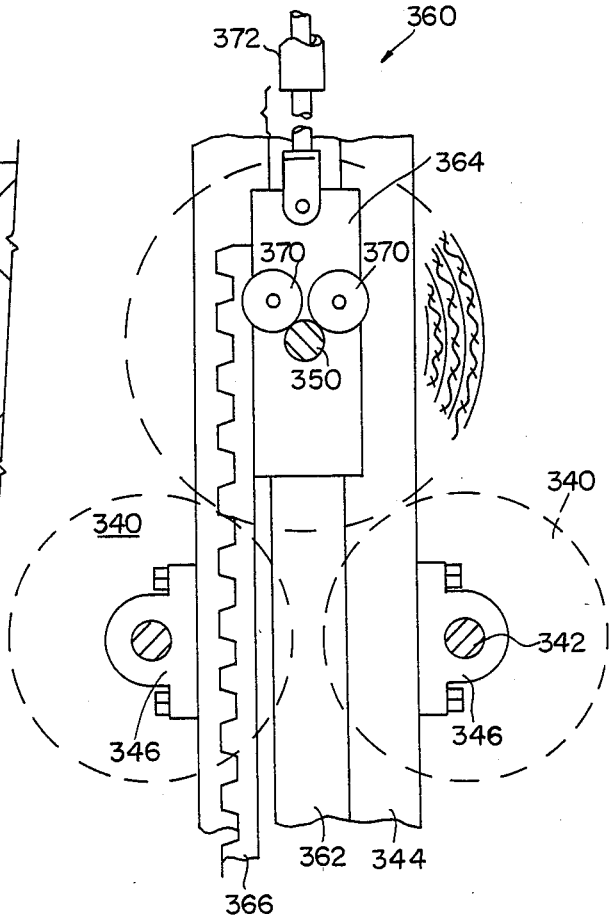
FIG.10
FIG.11
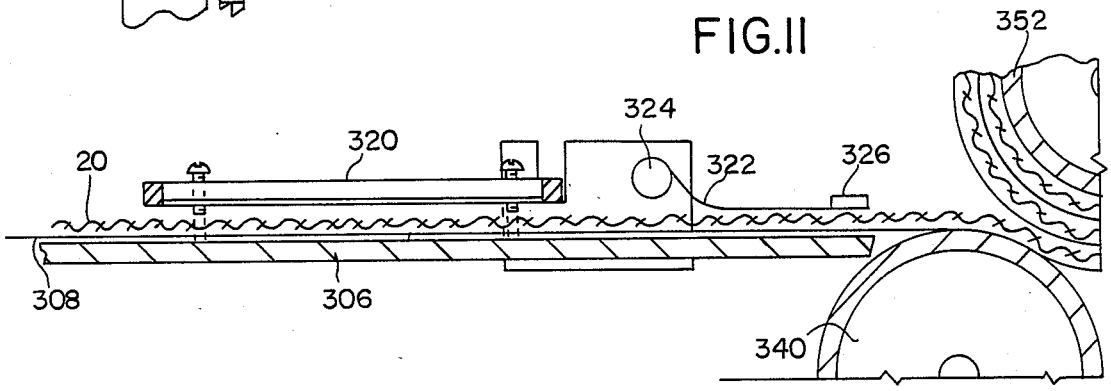

METHOD AND APPARATUS FOR MAKING BIASED FABRIC

BACKGROUND OF THE INVENTION

1. Field of the Invention

This invention relates to a method and apparatus for producing a biased fabric in which the structural fibers are skewed from the fabric centerline. The method and apparatus hereof is particularly useful in producing a flimsy, woven, biased structural fabric in which the structural fibers are oriented about 45° to the fabric centerline.

2. Background Description

Many types of structural fabrics are known, such as woven and nonwoven, biased and unbiased. Generally speaking, unbiased fabric has structural fibers running either parallel or perpendicular (or both) to the edges of the fabric. The configuration in which structural yarns run substantially parallel to the longitudinal edges and centerline of a flat, open-width, strip of fabric is called a "warp" configuration. The configuration in which the structural yarns run substantially perpendicular between the two longitudinal edges is called a "weft" configuration. Structural yarns may be held in place using secondary yarn or combined into a woven fabric having both weft and warp structural yarn. Fabric in which structural yarns are oriented at an angle skewed from the fabric centerline (neither parallel or perpendicular to the fabric centerline) is usually called a "biased" fabric.

Biased fabrics, particularly biased woven structural fabrics, have been found to have many advantages as a reinforcing structural material. For example, structural fiberglass fabrics can be combined with a thermosetting polyester resin to produce a fiberglass reinforced plastic. Such fiberglass reinforced plastic has many uses, such as in automobile bodies, aircraft fuselage, and marine craft.

Biased fabric is normally produced by processing a weft or warp knitted or woven fabric to skew the structural yarns. U.S. Pat. No. 4,567,738 illustrates an apparatus and method for producing a multi-layer nonwoven structural fabric. While various methods of producing a biased fabric have been useful in a variety of contexts, several types of material cannot be easily processed using known methods to produce a biased fabric. For example, many types of structural fabrics of interest are "flimsy" or "sleazy" in that the fabric is easily distorted by handling or even by its own weight if not supported. Such "flimsy" fabrics are particularly difficult to handle once the structural fibers are skewed from the weft or warp configuration. Therefore, using conventional methods it is difficult to maintain the integrity of the fabric during processing to produce a biased fabric.

Producing a biased structural fabric from such a sleazy starting fabric has become increasingly desirable in many applications, but has proven difficult to obtain using conventional fabrication techniques. Therefore, it would be a significant advance in the art if a method and apparatus were devised which could easily produce a biased structural fabric meeting precise product specifications, particularly where the starting fabric is a flimsy, sleazy, easily distorted fabric.

SUMMARY OF THE INVENTION

The problems outlined above are largely solved by the method and apparatus of the present invention. That is, the method and apparatus hereof efficiently produces a biased fabric in which the structural fibers are skewed at an angle from the fabric centerline (neither parallel or perpendicular). Advantageously, the method and apparatus of the present invention can process an extremely flimsy or sleazy fabric while maintaining the structural integrity of the fabric throughout the process. This allows a structural fabric to be produced in which the structural yarns are very accurately aligned at the desired orientation. The preferred embodiment describes a process for producing a woven fabric using graphite structural yarn in which the structural yarns are perpendicular to each other and oriented at about a 45° angle to the centerline of the flat, open-width strip of fabric produced.

Broadly speaking, the apparatus of the present invention includes a mechanism for axially feeding a tube of fabric in a first linear direction and a carrying means displaced from the feeding means in the first direction for moving the tube of fabric in the first direction while rotating the tube. A cutting mechanism is disposed below the carrying means for slitting the moving and rotating tube of fabric at an angle skewed from the first direction. Preferably, this cutting mechanism slits the moving and rotating tube of fabric at about a 45° helical angle around the tube with the slit strip of fabric falling away from the cutter and carrying means. A support mechanism is disposed beneath the carrying means for catching the cut strip of fabric and supporting the strip of fabric between the carrying means and a take-up mechanism for gathering the cut strip of fabric.

In one embodiment, the feeding mechanism operates not only to feed the tube of fabric in the first direction but to rotate the fabric as it feeds. For example, with the flattened tube of fabric wound into a roll the feeding mechanism includes a mandrel for engaging and feeding the roll of fabric, with the mandrel rotatable in a vertical plane perpendicular to the feeding first direction. In another embodiment, an opening mechanism is disposed adjacent to the feeding mechanism to open the tube of fabric from the flattened configuration.

In one embodiment, the carrying means includes a pair of elongated rollers adapted for engaging the inside of the open tube of fabric. Preferably, each roller includes a plurality of longitudinally oriented, longitudinally shiftable slats circumferentially spaced about the roller. Each roller includes a camming mechanism by which the slats shift longitudinally as the rollers rotate. The slats each include a pad for engaging the inside of the tube of fabric. The rollers not only rotate the tube of fabric, but also through the longitudinal shifting movement of the slats convey the tube of fabric in the first linear direction, pulling the tube of fabric from the feeding mechanism.

Preferably, the cutting mechanism is disposed beneath the carrying means to slit the tube of fabric on its underside as it rotates and moves linearly. With the rotational velocity of the tube of fabric approximately equal to the linear velocity of the tube of fabric, the cutter will make approximately a 45° cut relative to the first direction. This, of course, yields a flat, open width strip of a helically cut fabric in which the structural fibers are oriented at about a 45° angle to the centerline to the strip of fabric.

In one embodiment, the supporting mechanism includes a table extending from beneath the carrying mechanism to the take-up mechanism. While in many cases the table is acceptable support for the cut strip of fabric during transit to the take-up mechanism, in the case of extremely flimsy fabrics, friction between the table and cut strip of fabric can misalign the fabric before it is gathered at the take-up means. Therefore, in one preferred form the supporting mechanism includes a roll of plastic which travels along a path of travel beneath the carrying means for catching the strip of fabric as it is slit, and conveying the strip of fabric along the table to the take-up mechanism. In this embodiment, the plastic is wound along with the strip of fabric into a roll at the take-up mechanism.

In a broad form, the method of producing a fabric in accordance with the present invention includes the steps of: transporting the fabric in a first linear direction, axially rotating the tube of fabric, and slitting the tube of fabric as it rotates and moves in the first linear direction. The tube of fabric preferably comprises a fabric in which the structural fibers are oriented either parallel or perpendicular (or both) to the longitudinal axis of the tube—i.e. warp or weft. The rotating tube moving in the first direction is slit at an angle to produce a flat, open-width, strip of fabric in which the structural fibers are skewed relative to the centerline of the strip of fabric. The method is particularly advantageous for handling an extremely flimsy or sleazy fabric that can be easily distorted. In the preferred embodiment, a woven tube of fabric having graphite structural fibers is slit to produce a strip of fabric in which the structural fibers are oriented about 45° to the centerline of the strip of fabric.

BRIEF DESCRIPTION OF THE DRAWINGS

FIG. 2 is an elevational view of the feeding station of the present invention taken along lines 2—2 of FIG. 1, and showing in phantom the rotational movement of the feeding mandrel;

FIG. 3 is an enlarged vertical sectional view taken along line 3—3 of FIG. 1, depicting the operation of the fabric opener of the present invention;

FIG. 4 is an enlarged vertical sectional view taken along line 4—4 of FIG. 1, showing the engagement of the slatter rolls to the tube of fabric;

FIG. 9 is an enlarged, fragmentary, elevational view in partial section taken along line 9—9 of FIG. 1, depicting a portion of the take-up mechanism of the present invention;

FIG. 10 is an enlarged, fragmentary, elevational view in partial section taken along line 10—10 of FIG. 9, illustrating the fabric take-up mandrel and driving bed rolls; and FIG. 11 is an enlarged, fragmentary, vertical sectional view taken along line 11—11 of FIG. 1, depicting the fabric as it transitions from the supporting mechanism to the take-up mechanism of the present invention.

DESCRIPTION OF THE PREFERRED EMBODIMENTS

Figure 1:
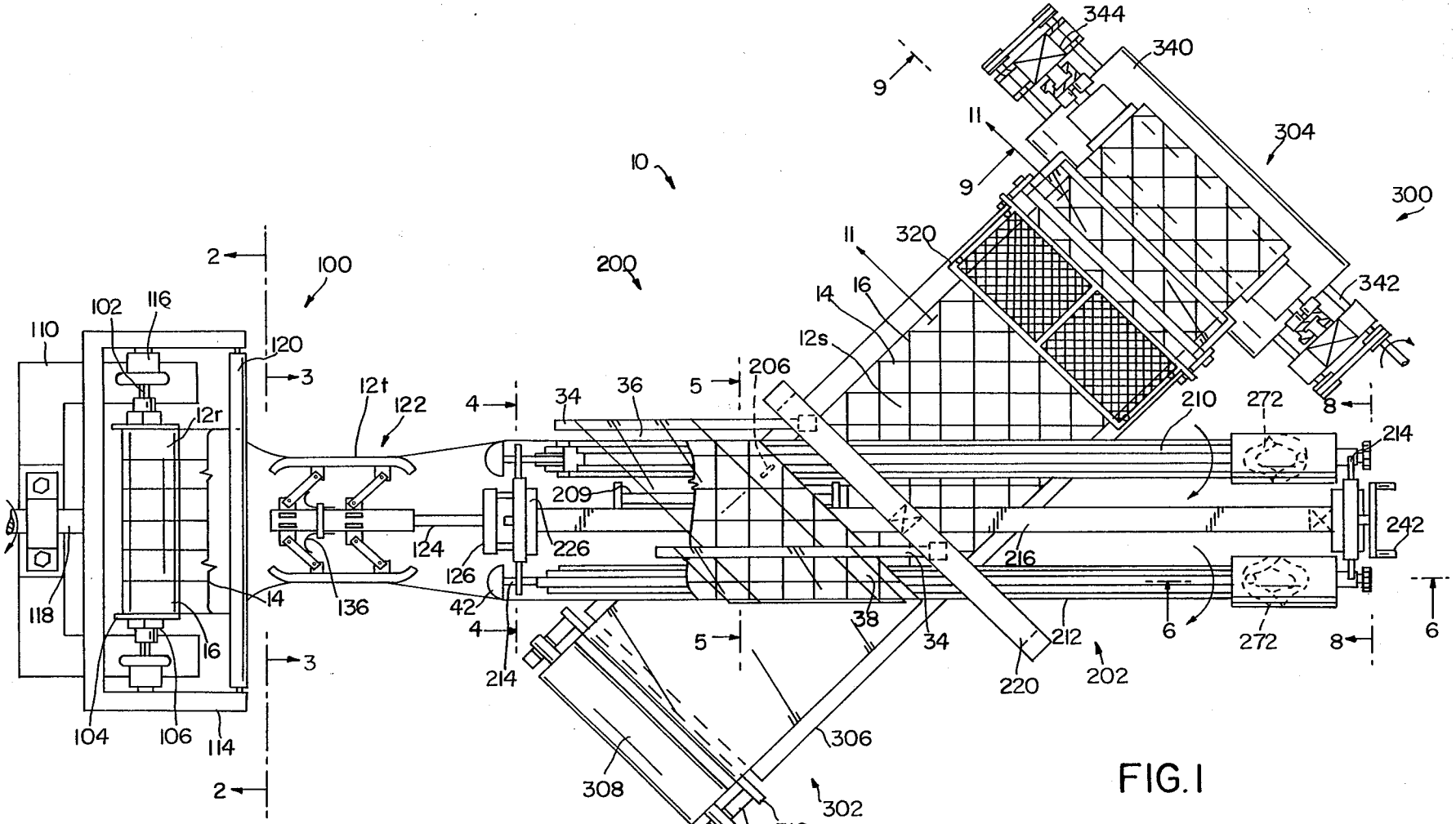
FIG. 1 is a plan view of the apparatus of the present invention.

Turning now to FIG. 1 of the drawings, an apparatus 10 in accordance with the present invention is illustrated. Broadly speaking, the apparatus 10 includes a feeding station 100, a slitting station 200, and a winding station 300. The function of the feeding station 100 is to hold and feed a roll **12*r* of structural fabric. In the illustrated embodiment, the roll of fabric 12*r* is a woven tube of fabric which has been flattened and wound into the configuration of the roll 12*r*. The fabric 12 is woven with generally perpendicular structural fibers 14 and 16 (weft and warp configuration), which in the illustrated embodiment are graphite fibers woven in an open-fabric configuration, yielding a flimsy, sleazy fabric which can easily lose its structural integrity. As shown in FIG. 1, the structural fibers 14 are in the warp configuration—that is structural fibers 14 run parallel and longitudinally along the tube in the axial direction. In contrast, the structural fibers 16 are in the weft configuration—that is perpendicular to the warp fibers 14. The weft structural fibers 16 actually run circumferentially around the tube of fabric. As such, the roll of fabric 12*r* is unbiased in that the structural fibers 14, 16** run parallel or perpendicular to the longitudinal axis of the tube of fabric.

Broadly speaking, the feeding station 100 feeds the tube of unbiased fabric 12 in a linear direction towards the slitting station 200. The fabric 12 is opened from the flattened roll configuration **12*r* to the open tube configuration 12*t* before reaching the slitting station 200. As the fabric 12 is fed from the feeding station 100 in the linear direction, the feeding station 100 imparts a rotational movement to the tube of fabric. The slitting station 200 engages the inside of the tube of fabric 12*t* and transports the fabric 12 linearly in the first direction while simultaneously rotating the tube of fabric 12*t*. The fabric 12*t* is cut in a helix angle on the underside of the tube of fabric 12*t* to produce a flat, strip of fabric 12*s* transported from the slitting station 200 to the winding station 300. As can be appreciated from FIG. 1, after the slitting operation, the structural fibers 14, 16 are oriented approximately 45° to centerline of the strip of fabric 12*s***.

1. The Feeding Station

The feeding station 100 is illustrated in detail in FIGS. 1 and 2. The fabric 12 comes from the loom to the apparatus 10 in rolled configuration **12*r*. The fabric 12 is woven into a tube and flattened into its rolled form. The roll of fabric 12 is placed on a mandrel approximately 4" in diameter, the mandrel having a square hole (about 1¼") through the axis of the mandrel. A steel bar 102 runs through the hole in the mandrel and extends on either side of the roll to support the roll of fabric 12*r* during let-off. Aluminum retaining disks 104 are placed over the mandrel adjacent the edges of the roll of fabric 12*r* to prevent the roll from sliding from side to side during rotation of the roll. Clamping rings 106 hold the retaining disks 104** in place.

As shown in FIG. 2, the feeding station 100 includes an upright pedestal section 110 stabilized by the base 112. Mounted to the top of the pedestal 110 is a let-off U-shaped bracket 114. As shown more clearly in FIG.

1, the bracket 114 includes a pair of rotatable chucks 116 for engaging the distal ends of the steel bar 102 for mounting the roll of fabric 12*r*. Mounting shaft 118 is affixed to the let-off bracket 114 at center point and is coupled to the pedestal 110 by a bearing housing. As can be seen in FIG. 1, the mounting shaft 118 extends through the bearing housing and is operably engaged to a motor for rotational movement of the let-off bracket 114 as shown.

A pair of elongated, parallel cylinders 120 are mounted across the open end of the let-off bracket 114 as shown in FIGS. 1 and 2. The cylinders 120 define a nip or groove therebetween, through which is fed the fabric 12. As can perhaps be more readily appreciated from FIG. 2, rotation of the mounting shaft 118 causes corresponding rotation of the let-off bracket 114 in the counterclockwise direction as shown in FIG. 2.

Turning now to FIGS. 1 and 3, the opener 122 is illustrated in more detail. The opener includes a free wheeling axle 124 which is mounted to a base 126. As shown in FIG. 1, the base 126 is coupled to one end of the slitting station 200. A cylindrical spindle 128 (FIG. 3) is mounted on bearing 130 about the fixed axle 124, to allow free-wheeling rotational movement of the spindle 128 about the axle 124. A plurality of arms 132 are mounted in a radial direction about the spindle 128 and carry a plurality of cylindrical skids 134 at their distal ends. As shown in FIGS. 1 and 3, the arms are pivotally coupled to the spindle 128 and to a respective skid 134, with the skids aligned in the first linear direction (direction of fabric movement). As shown in FIG. 1, a plurality of springs 136 radially outwardly bias the arms 132 and skids 134 connecting structure. The arm and skid arrangement is designed to outwardly bias and retain the fabric 12 into the open tube configuration 12*t*, while allowing the fabric 12 to easily move in the first linear direction along each skid 134. Further, the spindle 128 carrying the arms 132 and skids 134 is allowed to rotate as the tube of fabric rotates.

2. Slitting Station

The slitting station 200 broadly includes a carrying mechanism 202 and cutting mechanism 204. The carrying mechanism 202 is displaced from the feeding station 100 in a horizontal, first linear direction, which is the direction of movement of the tube of fabric 12*t*. The carrying mechanism 202 functions to simultaneously transport the tube of fabric 12*t* in the first linear direction while rotating the tube of fabric. The feeding station 100 rotates the tube of fabric 12*t* at the same speed to prevent twisting of the tube. In the preferred embodiment illustrated in FIG. 1, the linear velocity of the fabric in the first linear direction is approximately equal to the rotational velocity of the fabric.

The cutting mechanism 204 is preferably disposed below the carrying mechanism 202 to slit the underside of the moving and rotating tube of fabric 12*t* (see FIG. 5). The cutting mechanism 204 cuts the tube of fabric 12*t* at an angle skewed from the first linear direction to produce the flat strip of fabric 12*s* as shown in FIG. 1. Preferably, the cutting mechanism 204 slits the moving and rotating tube of fabric at about a 45° helix angle around the tube 12*t* to produce the strip of fabric 12*s*.

In more detail, the carrying mechanism 202 broadly includes a pair of elongated, cylindrical, parallel, spaced apart slatter rolls 210, 212. The slatter rolls 210, 212 are supported in a cantilevered fashion, having a free end proximate to the feeding station 100, a center support, and a supported end remote from the feeding station 100. The distal ends of the slatter rolls 210, 212 are interconnected by mounting assemblies 214. The mounting assemblies 214 are interconnected by an elongated tubular support beam 216 Which runs parallel between the slatter rolls 210, 212. A convex, bell-shaped, fabric guide 42 is mounted at the end of each slatter roll 210, 212 adjacent the opener 122 to help ease the fabric 12*t* onto the slatter rolls 210, 212.

Figure 5:
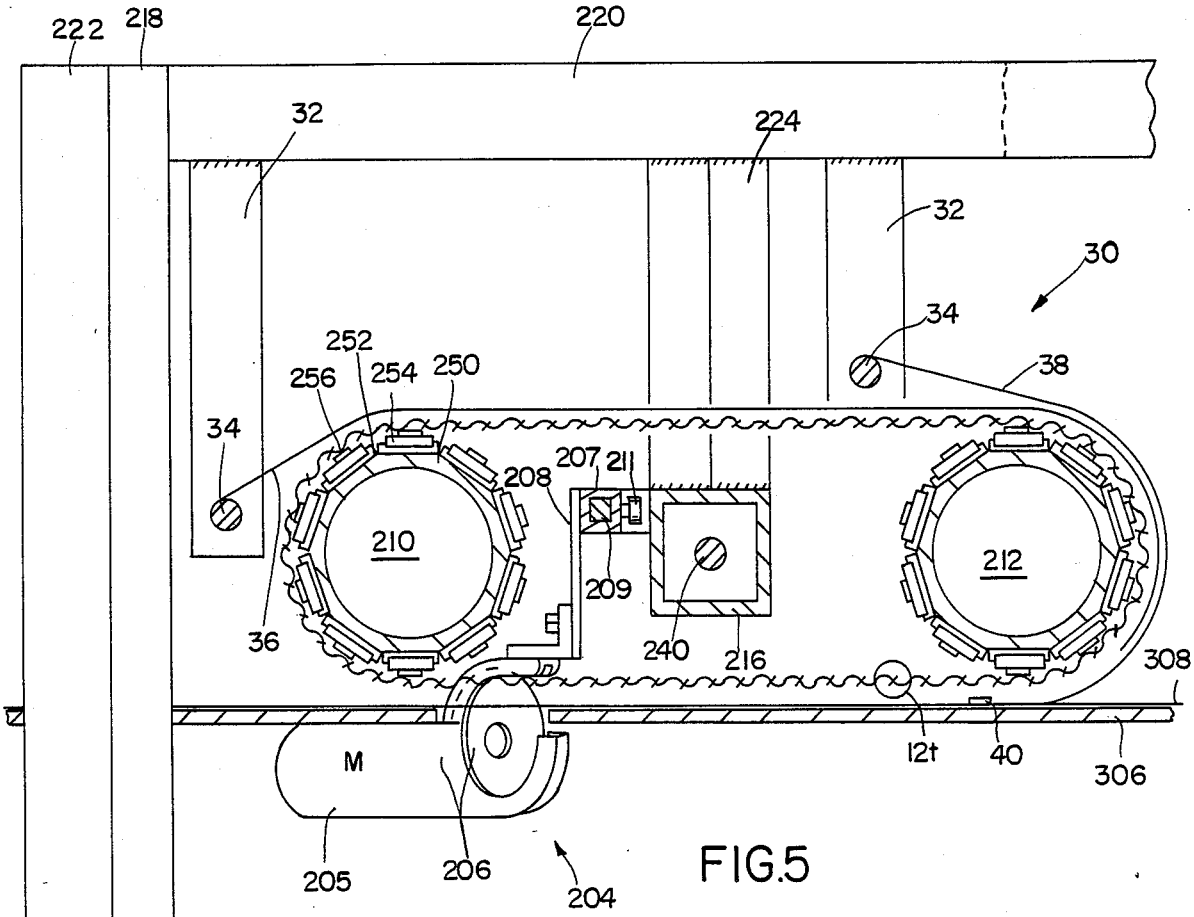
FIG. 5 is an enlarged elevational view in partial section, taken along line 5—5 of FIG. 1, depicting the disposition of the cutter relative to the slatter rolls and tube of fabric.

Turning to FIG. 5, the center support 218 is illustrated in more detail. The center support includes an elongated cross arm 220 which is supported at each end by vertical mast 222. A downcomer 224 extends vertically downward from a central location in the mast 222 and connects to the support beam 216. As shown in FIG. 1, the end of the support beam 216 remote from the feeding station 100 is supported vertically by a vertical riser similar to the masts 222.

Figure 8:
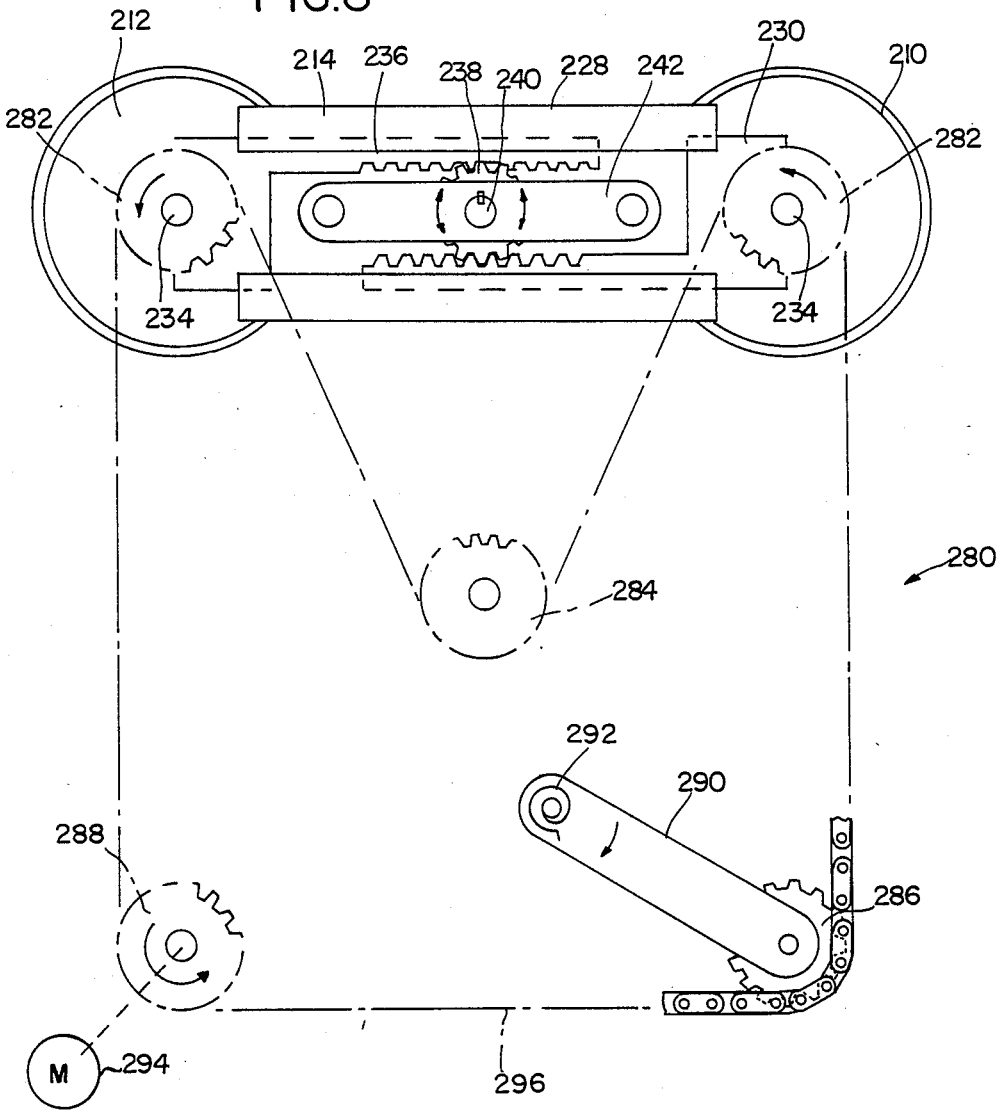
FIG. 8 is an enlarged, elevational view in partial section taken along line 8—8 of FIG. 1, showing the drive and adjusting mechanism of the slatter rolls.

FIGS. 1, 4, and 8 illustrate the mounting assemblies 214 in more detail. Secured to each distal end of the support beam 216 is a mounting plate 226 which carries a pair of spaced apart, parallel guides 228. A key 230 is slidably received in each guide 228 and includes a journal 232 centrally located in its enlarged end for rotatably receiving the shaft extensions 234 of each slatter roll 210 (see FIG. 4).

The extension portion of each key 230 includes a toothed rack 236 as shown in FIGS. 4 and 8. Interconnecting the spaced apart racks 236 is a geared pinion 238—rotatable movement of each pinion 238 meshing with racks 236 to adjust the distance between the respective keys 230. Pinions 238 are fixed to each end of elongated adjustment rod 240 which runs the length of and is enclosed by the support beam 216 (see FIG. 5). As shown in FIGS. 1 and 8, the adjustment rod 240 terminates at one end at handle 242. Rotational movement of the handle 242 rotates the rod 240 and the attached pinions 238, adjusting the spread between the slatter rolls 210, 212 while maintaining the rolls in parallel relation.

Figure 6:
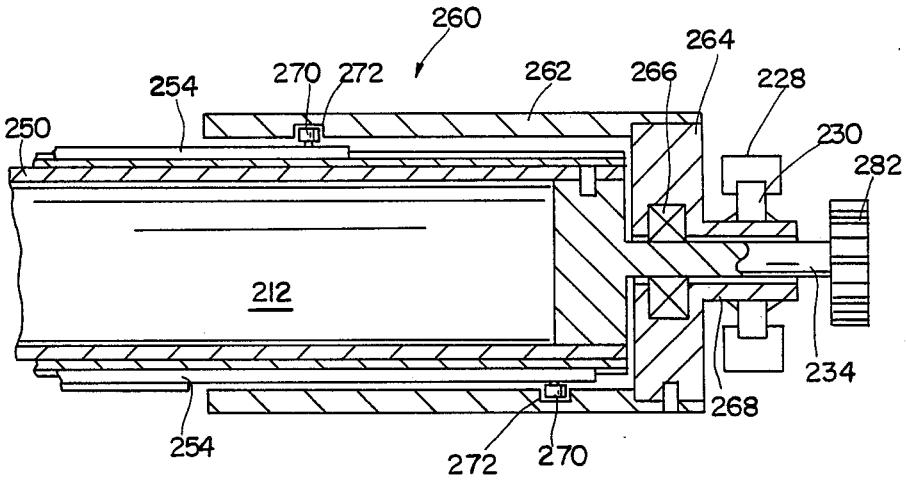
FIG. 6 is an enlarged, fragmentary, sectional view taken alone line 6—6 of FIG. 1, illustrating the drive and camming mechanism of one of the slatter rolls.

In more detail, each slatter roll 210, 212 includes an elongated, cylindrical hollow drum 250 with a shaft extension 234 concentrically attached at each end (FIG. 6). The outer surface of each drum 250 includes ten elongated, longitudinally oriented, keyways 252 which are circumferentially spaced around each drum 250 as shown in FIGS. 4 and 5. An elongated slat 254 is slidably received in each keyway 252 for longitudinal shifting movement along the drum 250. Each slat 254 includes an outwardly facing, pad 256 of tacky, felt material which is useful in engaging the fabric 12.

Figure 7:
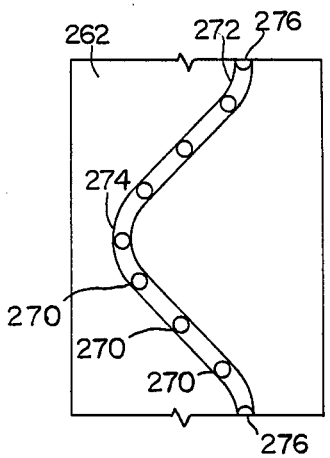
FIG. 7 is a reduced, developed view of the inside circumference of the cam housing illustrated in FIG. 6.

FIGS. 1, 6, and 7 illustrates the camming mechanism 260 which provides the longitudinal shifting movement of each slat 254 in its respective keyway 252. FIG. 6 illustrates one end of slatter roll 212, with slatter roll 210 being nearly identical. As shown in FIG. 6, a cam sleeve 262 envelopes one end of the drum 250. The mounting face 264 carries a bearing 266 for rotatably receiving the shaft 234. Extending outwardly from the mounting face 264 is the tubular arbor 268 through which the shaft 234 extends. As shown in FIG. 6, the arbor 268 is welded or otherwise secured to a respective key 230 (compare FIG. 4). Thus, it can be appreciated that the camming mechanism 260 is fixed, with the drum 250 adapted for rotational movement in the sleeve 262.

As shown in FIG. 6, each slat has a roller/pintle 270 extending radially outward adjacent its distal end. The pintles 270 are received in camway 272 defined on the inward facing surface of the cam sleeve 262. FIG. 7 illustrates the camway 272 in more detail. FIG. 7 is a developed view of the innersurface of the cam sleeve 262 on a scale of about ½ size of FIG. 6. The region of the camway 272 denoted by the numeral 274 represents the top, proximal region of the camway 272 as shown in FIG. 6 (compare FIG. 1). The region of the camway 276 represents the bottom, distal portion of camway 272 corresponding to FIG. 6. As the drum 250 rotates, each pintle 270 follows the camway 272 resulting in longitudinal shifting movement of the respective slat 254 along the respective keyway 256.

The cutting mechanism 204 as illustrated in FIG. 5 includes a fabric shear 205 operable to rotate the circular blade 206. Mounting bracket 207 is secured to support beam 216 and includes a vertical stud 208 to which the shear 205 is bolted. The stud 208 is actually slotted which allows adjustment of the shear 205 vertically relatively to the stud 208. Although the shear 205 is mounted to the bracket 207 so that the blade 206 is at a fixed angle, it will be appreciated that the mounting assembly can be easily reconfigured to adjust the angle of the blade 206. As shown in phantom in FIG. 1, in the preferred embodiment, the blade 206 is oriented at approximately a 45° angle relative to the longitudinal axis of the slatter rolls 210, 212.

The bracket 207 is actually slidably received on bar 209 which is secured to the support beam 216 (see FIG. 1). The bar 209 runs parallel to the support beam 216 allowing for slidable positioning of the bracket 207 along the bar 209 to achieve adjustment of the blade 206 in the longitudinal direction relative to the slatter rolls 210, 212. When the desired position is achieved, a set screw 211 in the bracket 207 can fix the position of the bracket 207 relative to the bar 209.

The fabric retention system 30 illustrated in FIG. 5 has been found surprisingly useful in sufficiently operating the apparatus 10. In the fabric retention system 30, a pair of vertical posts 32 extend downwardly from the cross arm 220, each vertical post 32 having an elongated cylindrical bar extending perpendicularly from its distal end (compare FIG. 1). An undersheet 36 is connected to the bar 34 adjacent the slatter roll 210 and extends laterally across both slatter rolls 210, 212. The undersheet 36 wraps around the outer diameter of the slatter roll 212 as shown in FIG. 5. A cover sheet 38 is connected to the bar 34 adjacent the slatter roll 212 and overlies the undersheet 36. The cover sheet 38 wraps around slatter roll 212 to a position beneath the slatter roll 212. A bar weight 40 is attached along the distal margin of the cover sheet 38 as shown in FIG. 5. As shown in FIG. 1, the sheets 36, 38 are angled (about 45°) to generally follow the helical cut made in the tube of fabric 12*t*.

The drive mechanism 280 of the slatter rolls 210, 212 is broadly illustrated in FIG. 8. As can be seen, a sprocket 282 is secured to the respective shafts 234 of the slatter rolls 210, 212. An idle gear 284 is centrally located below the mounting assembly 214, while a slack gear 286 and driven gear 288 are disposed below the idle gear 284 as shown in FIG. 8. The slack gear 286 is mounted to the pivot arm 290 which is biased by the pivot spring 292 in the direction shown. Motor 294 drives the driven gear 288 in the indicated direction. Chain 296 is hooked around the gears and sprockets, and of course drives the slatter rolls 210, 212 for rotation in the direction shown. It can be appreciated that adjusting the distance between the slatter rolls 210, 212 is possible with the gear 286 pivoting to accommodate the necessary adjustment in the chain path of travel.

3. Winding Station

Broadly speaking, the winding station 300 comprises a fabric support assembly 302 and a take-up mechanism 304. As shown in FIG. 1, the support assembly 302 includes an elongated table 306 extending diagonally under the slitting station 200 and leading to the take-up mechanism 304. As shown in FIG. 5, the table 306 is apertured for positioning the blade 206 therethrough. Preferably, the upper surface of the table 306 has a laminated plastic (e.g. Formica) surface to reduce surface friction. As shown in FIG. 1, the table 306 is oriented at about a 45° angle to the longitudinal axis of the slatter rolls 210, 212 to support the strip of fabric 12*s* during its travel to the take-up mechanism 304.

Because the fabric 12*s* is extremely sleazy and flimsy, it has little rigidity particularly after it is slit open at the slitting station 200. The pulling action by the take-up mechanism 304 on the fabric 12*s*, and the friction between the fabric 12*s* as it moves towards the take-up mechanism 304 and the laminated plastic surface of the table 306 can in some cases be sufficient to create tension sufficient to distort the fabric 12*s*. Therefore, in the preferred embodiment illustrated, the support assembly 302 includes a film of plastic 308 introduced between the table 306 and fabric 12*s* to act as a fabric support or carrier. As shown in FIG. 1, the end of the table 306 remote from the take-up mechanism 34 includes a pair of spaced apart yokes 310 for holding a roll of plastic 308. A guide bar 312 is provided to help ensure that the plastic sheet 308 travels across the surface of the table 306 in an even manner.

As the sheet of plastic 308 moves under the slatter rolls 210, 212 in the region of the cutting mechanism 204, it is positioned for catching the strip of fabric 12*s* as it is cut from the tube of fabric 12*t*. As shown in FIG. 5, the marginal portion of the plastic 308 is actually cut by the cutting mechanism 204 along with the fabric 12. Both the fabric 12*s* and plastic sheet 308 are wound into a roll at the take-up mechanism 304, with the take-up mechanism 304 providing the motive force of the plastic sheet 308 across the table 306.

As shown in FIGS. 1 and 11, an inspection grid 320 is preferably overlayed the fabric 20 in the region between the slatter rolls 210, 212 and the take-up mechanism 304. The wires in the inspection grid 320 are oriented at the desired angle for structural fibers 14, 16. Thus, an operator can view the structural fibers of the fabric 12*s* as it transits the inspection grid 320 and determine whether the quality is acceptable or whether adjustments are necessary to the apparatus 10. A hold-down sheet 322 is laid over the fabric 12*s* at the end of the table 306 as shown in FIGS. 1 and 11. To this end, a bar 324 rapidly traverses the table 306 to which the hold-down sheet 322 is attached. An elongated weight 326 rides at the end of the hold-down sheet 322 to downwardly bias the sheet 322 and fabric 12*s*.

The take-up mechanism 304 comprises a pair of bed rolls 340 longitudinally oriented transverse to the direction of movement of the fabric 12*s*. As shown in FIG. 11, the top surface of the bed roll 340 is approximately level with the surface of the table 306. This places the top surface of the bed rolls 340 slightly below the bottom of the slatter rolls 210, 212. Each bed roll 340 includes an elongated axle 342 concentrically extending from the axial surfaces of the bed roll 340. The take-up mechanism 304 includes a pair of vertical stands 344 spaced apart to receive the bed rolls 340 therebetween. Each vertical stand 344 includes a journal housing 346 for rotatably receiving the respective end of an axle 342. Each axle 342 extends through its respective journal 346 and terminates at pulley 348. As shown in FIG. 1, the respective pulleys 348 are interconnected by a belt or chain for simultaneous co-speed rotation. As shown in FIG. 1, one of the axles 342 extends beyond its respective pulley 348 and is driven by a motor (not shown).

The bed rolls 340 are spaced apart for receiving a cardboard tube placed between them. Using a cardboard tube having an approximately 6" inside diameter, the two bed rolls are spaced approximately 1½" apart. A mandrel is placed inside the cardboard tube, and as shown in FIGS. 9 and 10 includes a short shaft 350 projecting from each end.

A hold-down mechanism 360 is coupled to each vertical stand 344 to maintain the position of the fabric roll between the bed rolls 340; yet the hold-down mechanism 360 adjusts as the fabric roll increases in diameter as it gathers the fabric 12*s*. To this end, each vertical stand 344 defines a vertical groove 362 oriented towards the fabric (FIG. 10). A trolley 364 is slidably received in the groove 362 and includes an elongated, vertically oriented, toothed rack 366. A toothed gear 368 engages each rack 366 as shown in FIG. 9. As can be appreciated from FIG. 9, the spaced-apart gears 368 on each vertical stand 344 are interconnected by an axle to rotate simultaneously to effect corresponding simultaneous movement of each rack 366 vertically.

The trolley 364 carries a pair of spaced apart cylindrical lugs 370 facing the fabric roll and disposed for engaging the projecting shaft 350 of the mandrel as shown in FIGS. 9 and 10. That is, each shaft 350 is engageable by a pair of lugs 370 when the trolley 364 is lowered. A piston 372 is connected to the upper portion of each trolley 364, with its upper end fixed to an arm from the vertical stand 344 as shown in FIG. 9. Each piston 372 is telescopic over a wide range to allow the respective trolley 364 to be raised and lowered relative to the bed rolls 340. Preferably, the piston 372 is of the pneumatic dampening type with a controlled bleed orifice, allowing the piston 372 to be telescoped as desired. Nevertheless, the piston 372 provides a downward dampening affect on the shaft 350 with the trolley 364 lowered such that the lugs 370 engage the respective shaft 350.

Operation

The apparatus 10 is designed to slit any tube of fabric having weft or warp fibers to produce a strip of biased fabric in which the fibers are aligned at a desired angle skewed to the centerline of the strip of fabric. Thus, the apparatus 10 can process many different kinds of fabric, and by varying the angle of the blade 206 and the linear and rotational velocity of the fabric, the degree of fiber bias can be varied.

In FIG. 1, the roll of fabric 12*r* comes from the loom as a tube of fabric which has been flattened and rolled. The roll of fabric 12*r* is mounted on the steel bar 102 between retaining disks 104 and is easily positioned in the let-off bracket 114 by operation of the chucks 116. Initially, the fabric 12 must be set up by hand on the apparatus 10. That is, the fabric is fed between the cylinders 120 (FIG. 2) opened into tubular form 12*t*, slid around the opener 122 (FIG. 3) and positioned on the slatter rolls 210, 212 (FIG. 4). It should be understood that the configuration of the fabric 12*t* in FIGS. 3, 4, and 5 is considered tubular in the present application, although the shape of the tube in FIG. 3 is hexagonal while the shape of the fabric tube in FIGS. 4 and 5 is elliptical.

During set-up, the tube of fabric 12*t* is incrementally fed along the slatter rolls 210, 212 to the fabric shear 205. The shear 205 is operated to make the helical cut in the fabric tube 12*t*, with a flat, open width strip of fabric 12*s* dropping from the underside of the slatter rolls 210, 212 onto the plastic sheet 308. The plastic sheet 308 and strip of cut fabric 12*s* are positioned on the cardboard tube 352 of the take-up mechanism 304. The apparatus 10 is then ready for automated operation.

During operation of the apparatus 10, the fabric 12 slowly unwinds from the feeding station 100. The slitting station 200 actually provides the pull on the fabric 12*r* to unwind the fabric from the roll. As the fabric 12 is unwound, shaft 118 is operated to rotate the let-off bracket 114 in a vertical plane perpendicular to the linear direction of travel of the fabric 12*t*. Thus, the feeding station 100 operates to simultaneously rotate the roll of fabric in a vertical plane as it allows the tube of fabric to be pulled away.

It is believed that the rate of rotation (Rv) (in the vertical plane) is a direct function of the flattened width (FW) of the fabric on the roll, the rate at which the fabric is pulled away from the feeding station 100 (Pv), and the desired helix angle (A) (45° in the illustrated embodiment) in which the tube of fabric 12 is to be slit. The formula for determining the rotation rate of the let-off bracket 114 is:

$$Rv = \frac{Pv}{2FW \text{ TAN } A}$$

Where the helix angle (A) equals 45°:

$$Rv = \frac{Pv}{2FW}$$

While the feeding station 100 is being operated, the slitting station 200 is being simultaneously operated. The motor 294 is operated to drive the chain 296 which in turn rotates the slatter rolls 210, 212 (see FIGS. 6 and 8). The size of the sprockets 282 and rate of movement of the chain 296 is, of course, designed to achieve an identical rate of rotation of the tube of fabric 12t by the slatter rolls 210, 212 and by the let-off bracket 114. As can be appreciated from FIGS. 1, 6, and 7, as each slatter roll rotates, the pintle 270 on each slat 254 travels along the camway 272. This movement in turn translates into a linear movement of each slat 254 in its respective keyway 252.

Because the slatter rolls 210, 212 are configured to impart both a rotational movement and linear movement to the fabric 12*t*, it will be appreciated that the slats 254 are positioned on the respective slatter rolls in a complemental manner. As shown in FIG. 1, the top slats of the slatter roll 210 are in their furthest retracted position (left to right in FIG. 1, away from the feeding mechanism 100), while the top slats of the slatter roll 212 are in their furthest projected position (right to left towards the feeding mechanism 100 as shown in FIG. 1). The slats 254 are thus continuously complementally positioned as the respective slatter rolls 210, 212 rotate.

The positioning of the slats 254 is more clearly seen from FIG. 4. Viewing FIG. 4, the slats 254 on the inside diameter (inner half circle, facing the other slatter roll)

are not in engagement with the fabric 12. Conversely, the slats on the outer diameter (outer half circle) of the respective slatter roll 210, 212 are in engagement with the fabric 12. Considering the slatter roll 210 in FIG. 4, the bottom slat is in its furthest projected position while the top slat is in its furthest retracted position. In the transition from the bottom position to the top position each slat 254 of roll 210 engages the fabric (pad 256) and not only rotates the fabric, but moves the fabric in the first linear direction in line with the slats 254. When the slats 254 of the slatter roll 210 are in transit in the inner-half circle region, the slats 254 are not in engagement with the fabric 12 and are returning from the retracted position to the projected position.

In similar fashion (still FIG. 4), the slatter roll 212 operates to rotate and move the fabric in the first linear direction. That is, the top slat 254 of slatter roll 212 is in its furthest projected position for initially engaging the fabric 12. The bottom slat 254 of the slatter roll 212 is in its furthest retracted position. As the slats travel from top to bottom along the outer half circle, each slat 254 engages the fabric with pad 256, imparting linear and rotational movement.

As can be appreciated from FIGS. 4 and 5, the spread of the slatter rolls 210, 212 is important for properly engaging the tube of fabric 12. Turning the hand crank 242 repositions the rack 236 and pinion 238 to make adjustments in the spread between the slatter rolls 210, 212. This adjustment feature also allows for easier set up.

As shown in FIG. 5, the fabric shear 205 is operable during rotational and linear movement of the fabric 12 on the slatter rolls 210, 212. The blade 206 extends upward through the plastic sheet 308 and fabric 12 to affect a helical slit around the rotating and linearly moving tube of fabric 12*t*. The helix angle of the cut is largely determined by the rate of rotational movement and the rate of linear movement of the fabric. If the rate of rotational movement and the rate of linear movement are identical, the helix angle is 45°, which is the angle desired in the illustrated embodiment.

As the blade 206 cuts the fabric, the strip of fabric 20 falls away from the slatter rolls 210, 212 onto the moving sheet of plastic 308. The strip of fabric 20 is of course no longer a tube, but is a flat open-width strip of fabric 12*s*. The width of the fabric 12*s* can be determined as follows:

$$\text{fabric width} = 2FW \text{ SIN } A$$

where FW equals the original flattened tube width.

If the angle (A) is 45°, the fabric width = 1.414 FW.

As the strip of fabric 12*s* comes off the slatter rolls 210, 212, it is carried by the moving plastic sheet 308 under the inspection grid 320.

As shown in FIGS. 9–11, the plastic sheet 308 and fabric 20 are wound on the cardboard tube 352 at the take-up mechanism 304. The trolley 364 is lowered so that the lugs 370 engage respective shafts 350 to dampen movement. As the roll of fabric increases in diameter, the gears 368 are rotated to slowly raise the trolleys 364 to accommodate the increased fabric roll diameter.

It can be appreciated that the rotational speeds of the drive motors are very important through the entire process. To achieve the desired relative speeds of the driven components—feeding station 100, slitting station 200, and winding station 300—each station is equipped with a DC motor. Each DC motor is controlled by a variable speed SCR controlled drive system. A master control board (not shown) supplies these DC controllers with a signal which causes them to run in a controlled fashion over a wide speed range. To further ensure that the speeds are properly regulated, each motor is equipped with a tachometer which sends a signal to the master controller to monitor and control the speed of each motor. The operating speed range of the apparatus 10 in the illustrated embodiment is 1–10 yards per minute take-up speed.

What is claimed is:

1. A method of producing a fabric in which the structural fibers are skewed relative to the fabric centerline, comprising the steps of:

transporting in a first linear direction a tube of fabric in which the structural fibers are oriented either generally parallel or generally perpendicular to the longitudinal axis of the tube;

axially rotating the tube as the tube is transported in the first direction;

said transporting and rotating steps being performed with a roll means to prevent any significant linear or axial force from being exerted on the fabric;

slitting the tube at an angle skewed to the first direction as the tube rotates and moves in the first direction to produce a flat, strip of fabric in which the structural fibers are skewed relative to the centerline of the strip of fabric.

2. The method according to claim 1, including the steps of gathering the slit strip of fabric and supporting the strip between the slitting and gathering steps to maintain fabric integrity.

3. The method according to claim 2, the supporting step including the substep of transporting a sheet of supporting material underneath the slit strip of fabric to support the strip of fabric in movement between the slitting and gathering locations.

4. The method according to claim 2, the gathering step including the substeps of transporting the slit strip of fabric in a second direction oriented relative to the first direction at about said skewed angle, and winding the strip of fabric into a roll.

5. The method according to claim 1, including the step of feeding the tube of fabric in the first direction by unwinding a roll of flattened, tubular fabric and rotating the roll in a plane generally perpendicular to the first direction as the fabric unwinds.

6. The method according to claim 1, in which the tube of fabric comprises a woven fabric having weft and warp structural fibers and the slit strip of fabric having perpendicular structural fibers skewed relative to the fabric centerline.

7. The method according to claim 1, the slitting step making a cut in the tube of fabric at about a 45 helix angle around the rotating and moving tube of fabric.

8. The method according to claim 25, in which the velocity of the movement of the tube of fabric in the first linear direction is about the same as the velocity of the rotational movement of the tube to make a cut in the fabric at about a 45° helix angle.

9. An apparatus for producing a fabric in which the structural fibers are skewed from the fabric centerline, comprising:

means for axially feeding a tube of fabric in a first linear direction;

carrying means displaced from said feeding means in the first direction for moving the tube of fabric in the first linear direction and for rotating the tube, said carrying means including roll means for engaging the inside of the tube of fabric to simultaneously transport the tube of fabric linearly and rotate the tube;

means disposed adjacent said carrying means for cutting the moving and rotating tube of fabric at an angle skewed from said first direction to produce a strip of fabric;

means disposed adjacent said carrying means for supporting the cut strip of fabric; and take-up means disposed adjacent said supporting means and skewed at an angle from said first direction for engaging and gathering the cut strip of fabric.

10. The apparatus according to claim 9, the cutting means being disposed below said carrying means and operable for slitting the moving and rotating tube of fabric at about a 45° helix angle around the tube of fabric, to yield a strip of fabric having structural fibers skewed about 45° from the centerline of the strip of fabric.

11. The apparatus according to claim 10, the supporting means being disposed below the carrying means and operable for supporting the cut fabric along a path of travel at about a 45° angle to the first direction.

12. The apparatus according to claim 9, the feeding means being operable for rotating the tube of fabric as the fabric feeds.

13. The apparatus according to claim 12, the feeding means including a mandrel adapted for receiving a roll of flattened tubular fabric, the mandrel being mounted for rotating in a plane normal to said first direction.

14. The apparatus according to claim 13, including means for opening the tube of fabric as the fabric is fed from the mandrel to the carrying means.

15. The apparatus according to claim 9, the roll means including a pair of elongated rollers adapted for engaging the inside of the tube of fabric and longitudinally oriented in the first direction.

16. The apparatus according to claim 15, each roller including a plurality of longitudinally oriented, longitudinally shiftable, elongated slats circumferentially spaced about the roller.

17. The apparatus according to claim 16, each slat including a radially outwardly oriented pad for engaging the fabric.

18. The apparatus according to claim 16, including means for rotating the rollers, each slot including a pintle received in a camway for longitudinally shifting each slat as the respective roller rotates.

19. The apparatus according to claim 15, the rollers being parallel to each other, and including means for adjusting the distance between the rollers.

20. The apparatus according to claim 15, including fabric retention means adapted for engaging the fabric carried by the rollers and for biasing the fabric towards the rollers in the region of the cutting means.

21. The apparatus according to claim 9, the cutting means comprising a rotatable blade aligned in a cutting plane oriented at about a 45° angle skewed from the first direction.

22. The apparatus according to claim 9, the supporting means including an elongated table oriented at said skewed angle to the first direction.

23. The apparatus according to claim 9, the supporting means including a sheet of material for catching the fabric as the fabric is cut.

24. The apparatus according to claim 23, the sheet of material comprising a roll of material conveyed along a path of travel traversing beneath the carrying means in a second direction oriented at said skewed angle to the first direction.

25. The apparatus according to claim 24, the take-up means comprising a mandrel for winding the cut fabric and supporting material simultaneously into a roll.

26. The apparatus according to claim 9, the take-up means comprising a pair of driving bed rolls carrying a mandrel therebetween, the mandrel operable for rolling up the cut strip of fabric.

27. The apparatus according to claim 9, the supporting means including a flat table and the take-up means including a cylindrical mandrel, the mandrel being disposed at the end of the table remote from the carrying means with the lowermost margin of the mandrel disposed about level with the supporting surface of the table.

28. The apparatus according to claim 27, including hold-down means for allowing the mandrel to raise as fabric is wound, to maintain the lowermost margin of the fabric-wound mandrel about level with the supporting surface of the table.

29. The apparatus according to claim 27, including holding means for biasing the cut fabric downward as the fabric comes off the table.

30. The apparatus according to claim 9, the supporting means including an elongated table oriented at said skewed angle to said first direction, the take-up means being disposed at the end of the table for transporting said cut strip of fabric along the table and for gathering the cut strip of fabric.

31. The apparatus according to claim 30, the supporting means including a sheet of supporting material passing under the carrying means and along the table for transporting the cut strip of fabric from the cutting means to the take-up means.

32. The apparatus according to claim 9, including means for inspecting the skewed angle of the structural fibers relative to the fabric centerline, the inspecting means being disposed between the cutting means and the take-up means.

33. A system adapted for processing a woven tube of unbiased fabric to produce a flat strip of biased fabric, in which the structural fibers are oriented at a skewed angle to the fabric marginal edges, the system comprising:

a fabric feeding station having means for holding a roll of said tube of unbiased fabric, said holding means being operable for permitting fabric take-off in a first linear direction and for rotating said tube of fabric as it moves in said first linear direction;

a fabric slitting station disposed proximate the feeding station in the first direction including roll means for engaging the inside of the tube of fabric to transport the fabric linearly in the first direction and simultaneously rotate the tube of fabric, cutting means disposed beneath the roll means for slitting the tube of fabric at an acute angle in a helix around the tube of fabric to produce a strip of biased fabric in which the structural fibers are oriented at a skewed angle relative to the longitudinal edges of the strip of fabric, and support means disposed beneath said roll means and extending outwardly therefrom in a second direction for supporting the strip of fabric for movement in the second direction; and a fabric winding station disposed proximate said slitting station in said second direction, including a mandrel for rolling up the strip of fabric.

34. The system of claim 33, the feeding station including a mandrel adapted for receiving a roll of flattened tubular fabric, the mandrel being mounted for rotating in a plane normal to said first direction.

35. The system of claim 33, the feeding station including means for opening the tube of fabric is fed from said holding means to the slitting station.

36. The system of claim 33, the roll means including a pair of elongated rollers adapted for engaging the inside of the tube of fabric and longitudinally oriented in the first direction.

37. The system of claim 36, each roller including a plurality of longitudinally oriented, longitudinally shiftable, elongated slats circumferentially spaced about the roller.

38. The system of claim 33, the support means including a sheet of material for catching the fabric as the fabric is cut.

39. The system of claim 33, said support means comprising a table, said winding station including hold-down means for allowing the mandrel to raise as fabric is wound, to maintain the lowermost margin of the fabric-wound mandrel about level with the supporting surface of the table.

40. An apparatus for producing a fabric in which the structural fibers are skewed from the fabric centerline, comprising:

means for axially feeding a tube of fabric in a first linear direction;

carrying means displaced from said feeding means in the first direction, including roll means for engaging the inside of the tube of fabric, for moving the tube of fabric in the first linear direction and for rotating the tube;

means disposed below said carrying means for cutting the moving and rotating tube of fabric at an angle skewed from said first direction to produce a strip of fabric, the cutting means being operable for slitting the moving and rotating tube of fabric at said skewed angle around the tube of fabric;

means disposed below said carrying means for supporting the cut strip of fabric; and take-up means disposed adjacent said supporting means and skewed at an angle from said first direction for engaging and gathering the cut strip of fabric.

* * * * *